US011196201B2

(12) United States Patent
Miyamura et al.

(10) Patent No.: US 11,196,201 B2
(45) Date of Patent: Dec. 7, 2021

(54) MALE TERMINAL AND CONNECTOR PAIR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Tetsuya Miyamura, Mie (JP); Hajime Kawase, Mie (JP); Hajime Matsui, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/761,617

(22) PCT Filed: Nov. 15, 2018

(86) PCT No.: PCT/JP2018/042273
§ 371 (c)(1),
(2) Date: May 5, 2020

(87) PCT Pub. No.: WO2019/102924
PCT Pub. Date: May 31, 2019

(65) Prior Publication Data

US 2020/0328548 A1 Oct. 15, 2020

(30) Foreign Application Priority Data

Nov. 24, 2017 (JP) ..... JP2017-225508

(51) Int. Cl.
*H01R 13/20* (2006.01)
*H01R 13/05* (2006.01)
(Continued)

(52) U.S. Cl.
CPC ..... *H01R 13/20* (2013.01); *H01R 13/055* (2013.01); *H01R 13/113* (2013.01); *H01R 13/4538* (2013.01)

(58) Field of Classification Search
CPC ..... H01R 13/4538
(Continued)

(56) References Cited

U.S. PATENT DOCUMENTS 2,082,986 A * 6/1937 Staley ..... H01R 13/4538 439/140
5,599,200 A 2/1997 Yagi et al.
(Continued)

FOREIGN PATENT DOCUMENTS

JP 05-065071 8/1993
JP 07-307186 11/1995
(Continued)

OTHER PUBLICATIONS

Official Communication issued in International Bureau of WIPO Patent Application No. PCT/JP2018/042273, dated Feb. 5, 2019.

*Primary Examiner* — Ross N Gushi
(74) *Attorney, Agent, or Firm* — Greenblum & Bernstein, P.L.C.

(57) ABSTRACT

A male terminal includes a terminal body having a tab extending forward, and a cover slidable between a protection position where the tab is accommodated inside a sheath portion and a retracted position where a front end part of the tab is exposed from the front end of the sheath portion.

6 Claims, 18 Drawing Sheets

(51) Int. Cl.
*H01R 13/11* (2006.01)
*H01R 13/453* (2006.01)

(58) Field of Classification Search
USPC ..... 439/141
See application file for complete search history.

(56) References Cited

U.S. PATENT DOCUMENTS

| | | | | |
|---|---|---|---|---|
| 8,641,446 | B1 * | 2/2014 | Chen | H01R 13/4538 439/578 |
| 9,070,995 | B2 * | 6/2015 | Yagome | H01R 13/4538 |
| 2015/0280330 | A1 | 10/2015 | Oka | |

FOREIGN PATENT DOCUMENTS

| | | |
|---|---|---|
| JP | 2008-071704 | 3/2008 |
| JP | 2015-185448 | 10/2015 |

* cited by examiner

MALE TERMINAL AND CONNECTOR PAIR

TECHNICAL FIELD

A technique disclosed in this specification relates to a technique for protecting a tab of a male terminal.

BACKGROUND ART

A male terminal including a tab projecting forward from a terminal body is known from patent literature 1. The male terminal is electrically connected to a female terminal including a connecting tube portion into which the tab is insertable.

CITATION LIST

Patent Literature

Patent Literature 1: Japanese Unexamined Patent Publication No. 2015-185448

SUMMARY OF INVENTION

Technical Problem

In the female terminal, a resilient contact piece serving as an electrical contact with the tab is disposed inside the connecting tube portion. Since this suppresses the collision of an external matter with the resilient contact piece, troubles such as the deformation of the resilient contact piece are less likely to occur.

However, since the tab serving as an electrical contact with the resilient contact piece projects in the case of the male terminal, an external matter may collide with this tab. Then, the tab is deformed and there is a concern that a predetermined contact pressure cannot be obtained between the tab and the resilient contact piece of the female terminal.

The technique disclosed in this specification was completed on the basis of the above situation and aims to provide a technique for protecting a tab of a male terminal.

Solution to Problem

The technique disclosed in this specification is directed to a male terminal with a terminal body including a tab extending forward, and a cover slidable between a protection position where the tab is accommodated inside a sheath portion and a retracted position where a front end part of the tab is exposed from a front end of the sheath portion.

According to the above configuration, since the tab can be accommodated into the sheath portion by moving the cover to the protection position, the tab can be protected from collision from an external matter. Further, a mating terminal and the tab can be electrically connected by moving the cover to the retracted position and exposing the tab.

The following modes are preferable as embodiments of the technique disclosed in this specification.

Preferably, a front retaining portion for restricting a forward movement of the cover beyond the protection position by engaging a front retaining/engaging portion provided on the cover from front is provided on either one of the tab and the terminal body.

According to the above configuration, the cover can be prevented from coming off forward.

Preferably, a rear retaining portion for restricting a rearward movement of the cover beyond the retracted position by engaging a rear retaining/engaging portion provided on the cover from behind is provided on either one of the tab and the terminal body.

According to the above configuration, the cover can be prevented from coming off rearward.

Further, the technique disclosed in this specification is directed to a connector pair with a male connector including the above male terminal, and a female connector connectable to the male connector, wherein the male connector includes a receptacle to be externally fit to the female connector, the tab accommodated in the sheath portion of the cover held at the protection position is disposed in the receptacle, the female connector includes a cover contact portion for coming into contact with a front end part of the cover from front, and the cover is moved from the protection position to the retracted position by the cover contact portion coming into contact with the cover from front in connecting the female connector to the male connector.

According to the above configuration, since the cover can be moved from the protection position to the retracted position in the process of connecting the female connector and the male connector, the efficiency of a connecting operation of the connector pair can be improved.

Effect

According to the technique disclosed in this specification, it is possible to protect a tab of a male terminal.

EMBODIMENTS OF INVENTION

Embodiment

Hereinafter, one embodiment of the technique disclosed in this specification is described with reference to FIGS. 1 to 18. A male terminal 10 according to this embodiment is accommodated in a male connector 11. The male connector 11 and a female connector 12 connectable to the male connector 11 constitute a connector pair 13. In the following description, a Z direction represents an upward direction, a Y direction represents a forward direction and an X direction represents a leftward direction. Further, for a plurality of identical members, only some may be denoted by a reference sign and the other members may not be denoted by the reference sign.

(Male Terminal 10)

Figure 1:
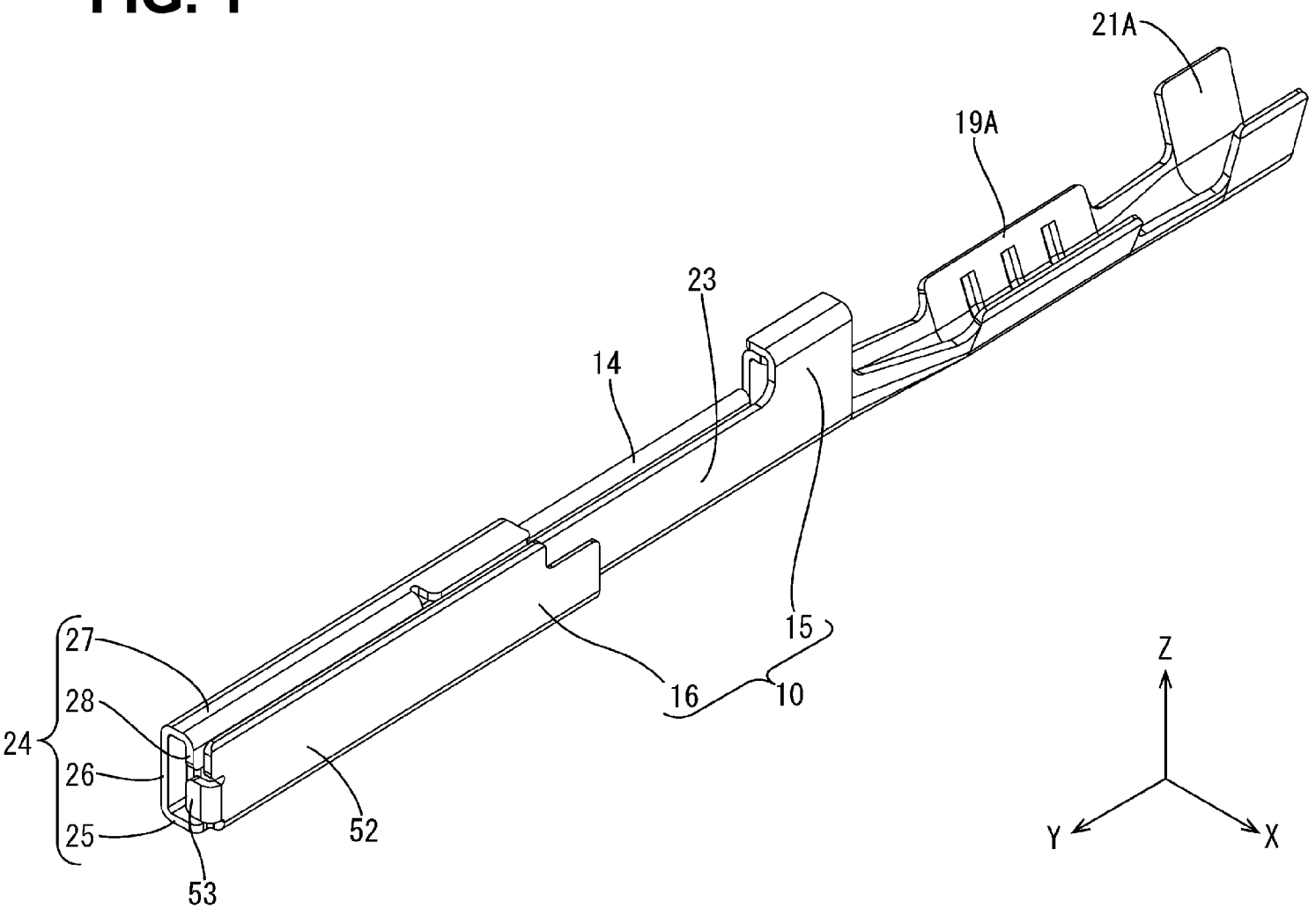
FIG. 1 is a perspective view showing a state where a cover is disposed at a protection position in a male terminal according to one embodiment.
Figure 2:
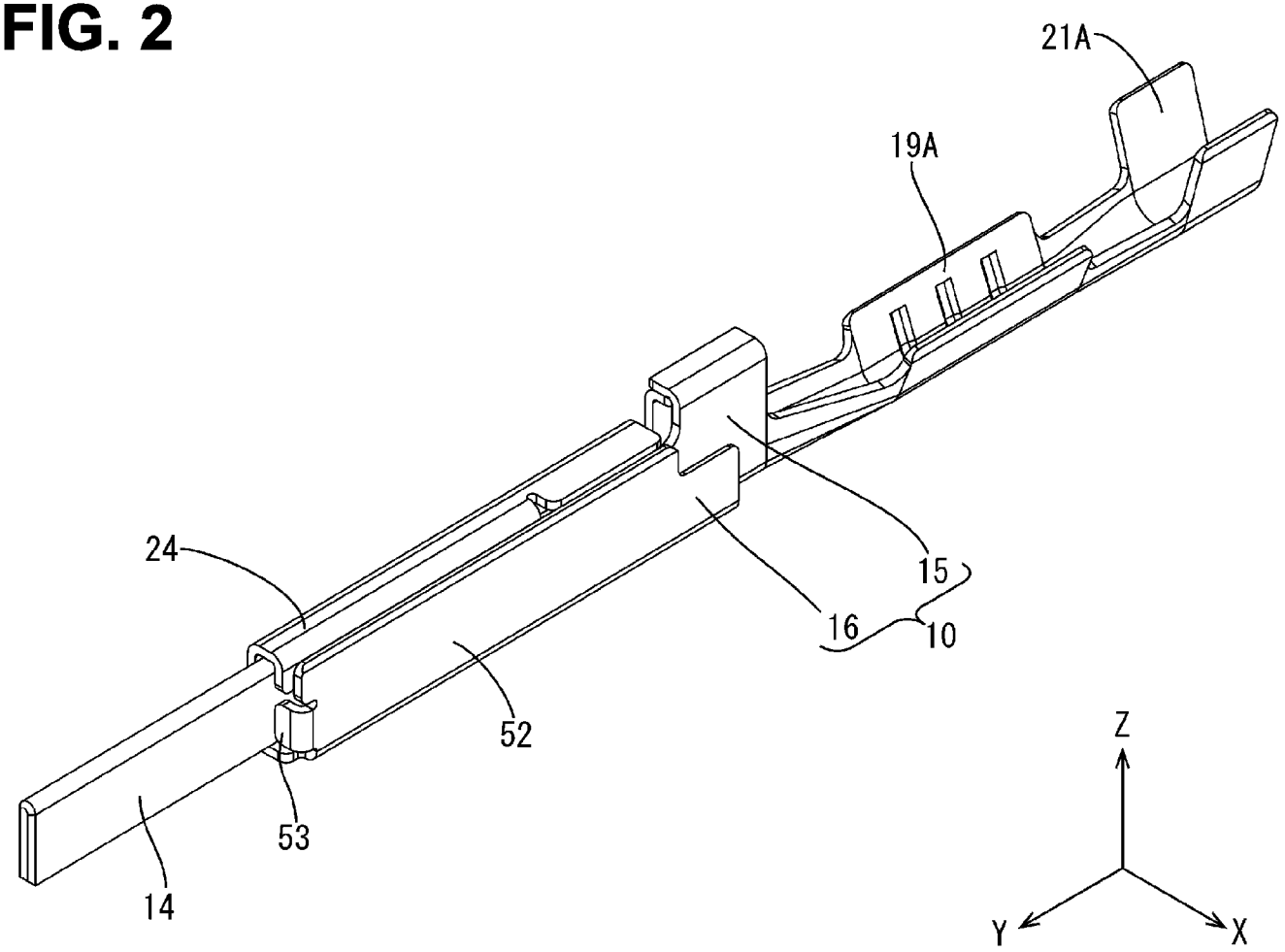
FIG. 2 is a perspective view showing a state where the cover is disposed at a retracted position.
Figure 3:
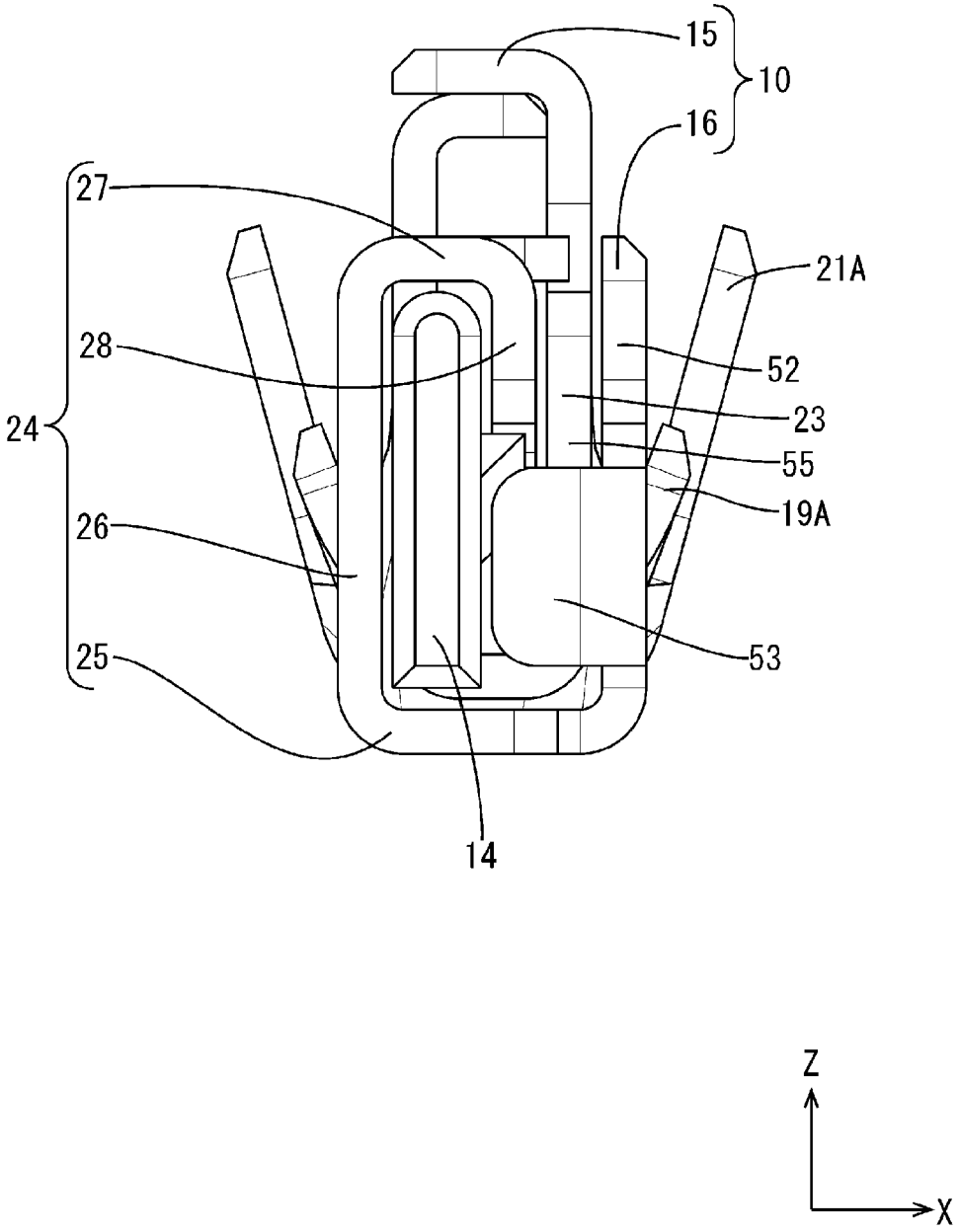
FIG. 3 is a front view showing the male terminal.

As shown in FIGS. 1 to 3, the male terminal 10 is provided with a terminal body 15 having a rectangular tube shape and including a tab 14 extending forward, and a cover 16 including a sheath portion capable of accommodating the tab 14.

The male terminal 10 is formed by press-working a metal plate material into a predetermined shape. An arbitrary metal such as copper, copper alloy, aluminum or aluminum alloy can be selected according to need as a metal constituting the male terminal 10. The male terminal 10 according to this embodiment is made of copper or copper alloy. A plating layer is formed on a surface of the male terminal 10. An arbitrary metal such as tin or nickel can be appropriately selected according to need as a metal for forming the plating layer. A tin plating layer is formed on the surface of the male terminal 10 in this embodiment.

(Terminal Body 15)

Figure 4:
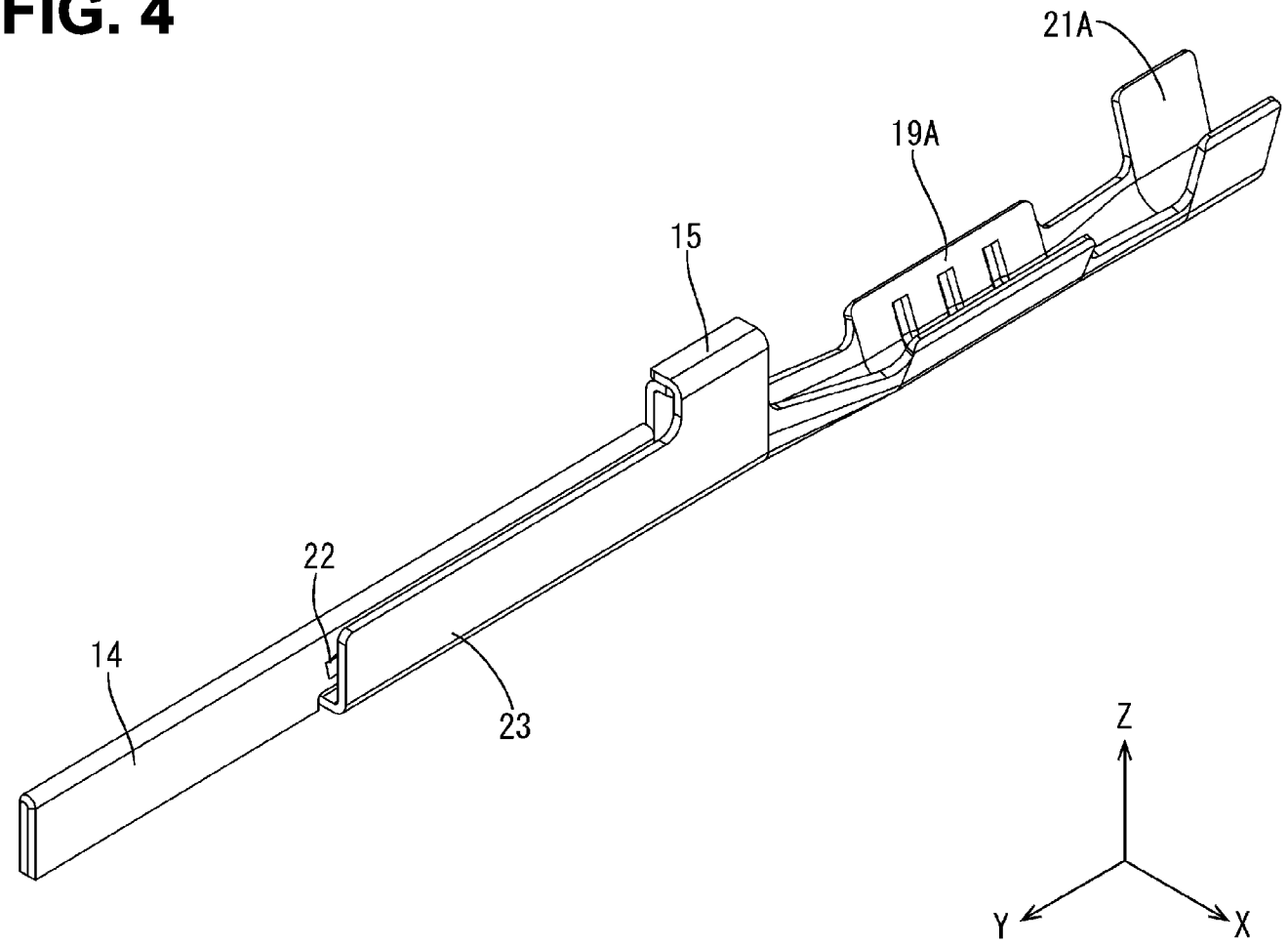
FIG. 4 is a perspective view showing a terminal body.
Figure 5:
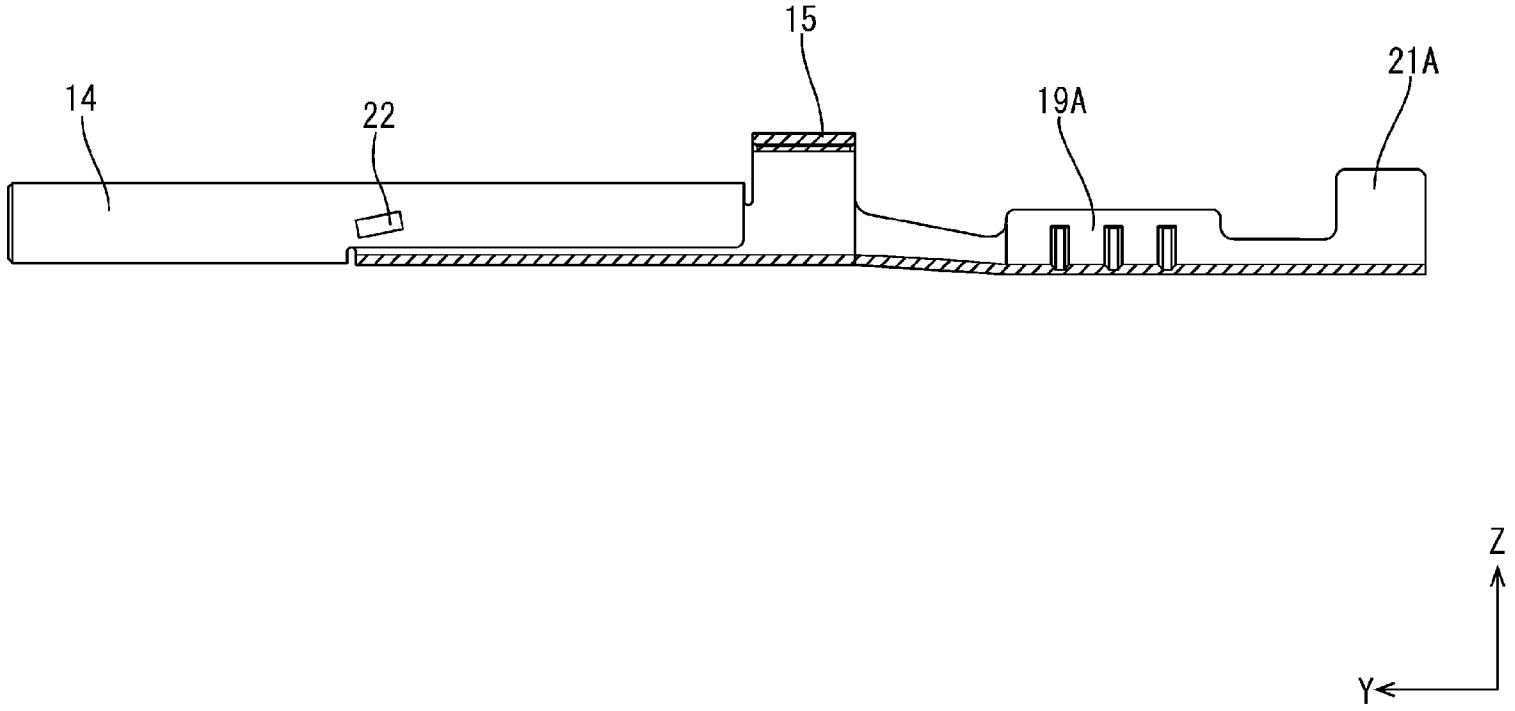
FIG. 5 is a section showing the terminal body.
Figure 6:
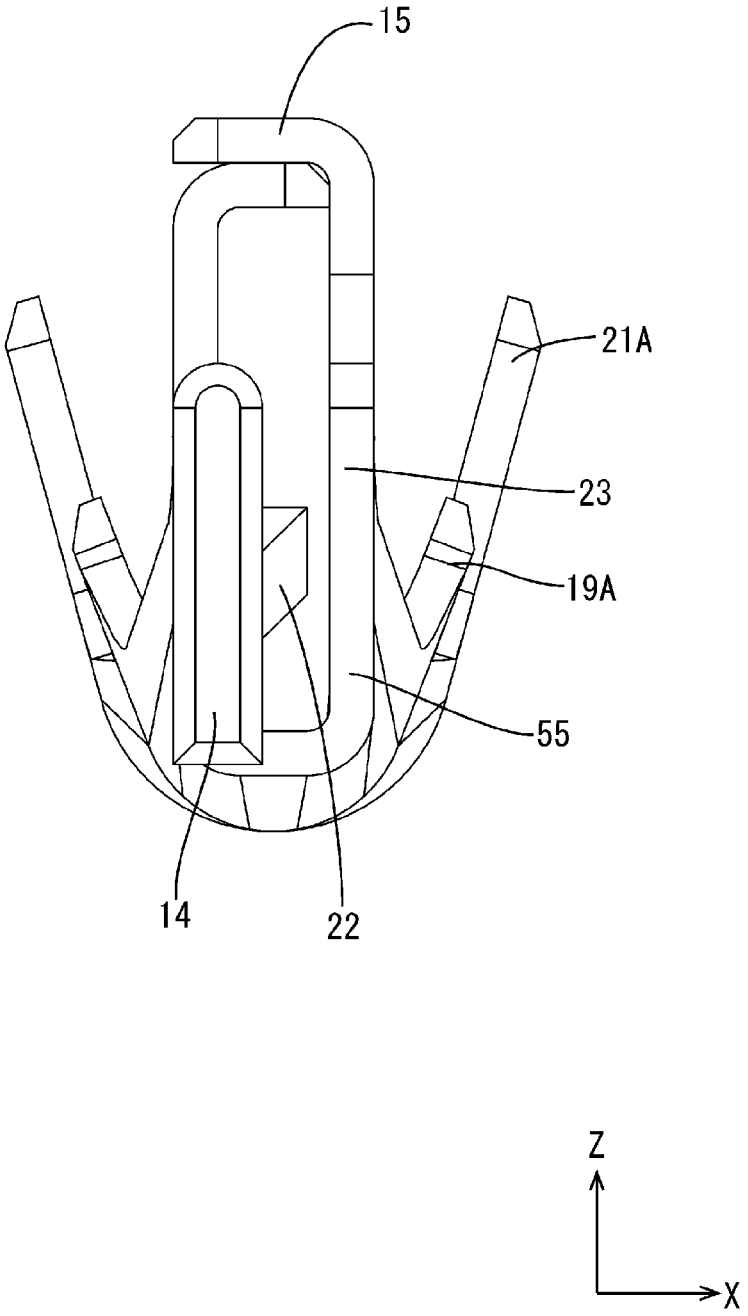
FIG. 6 is a front view showing the terminal body.

As shown in FIGS. 4 to 6, the terminal body 15 is in the form of a rectangular tube flat in a lateral direction. A wire barrel 19A to be crimped to a core 18A of a wire 17A is formed behind the terminal body 15. An insulation barrel 21A to be crimped to an insulation coating 20A surrounding the outer periphery of the core 18A is formed behind the wire barrel 19A.

The tab 14 is formed into a plate flat in the lateral direction by folding the metal plate material. The tab 14 has a rectangular shape elongated in a front-rear direction when viewed laterally. A front retaining portion 22 projecting leftward is provided near a center of the tab 14 in the front-rear direction. The front retaining portion 22 is formed by cutting the metal plate material constituting the tab 14 and raising a cut part to extend leftward. The front retaining portion 22 has a rectangular shape when viewed from left. A front end part of the front retaining portion 22 is set to be somewhat lower than a rear end part.

An extended side wall 23 extending forward is formed on a left side wall of the terminal body 15. The extended side wall 23 is formed to extend in parallel to the tab 14 while being spaced apart from the tab 14 in the lateral direction. A length in the front-rear direction of the extended side wall 23 is set to be substantially half that of the tab 14. Thus, a front half part of the tab 14 projects forward from a front end part of the extended side wall 23. The front retaining portion 22 formed on the tab 14 is located behind the front end part of the extended side wall 23.

The upper end edge of the tab 14 and that of the extended side wall 23 are set substantially at the same height position in a vertical direction. A vertical height of the tab 14 and that of the extended side wall 23 are set to be substantially half that of the terminal body 15. In this way, the terminal body 15 projects further upward than the tab 14 and the extended side wall 23.

(Cover 16)

Figure 7:
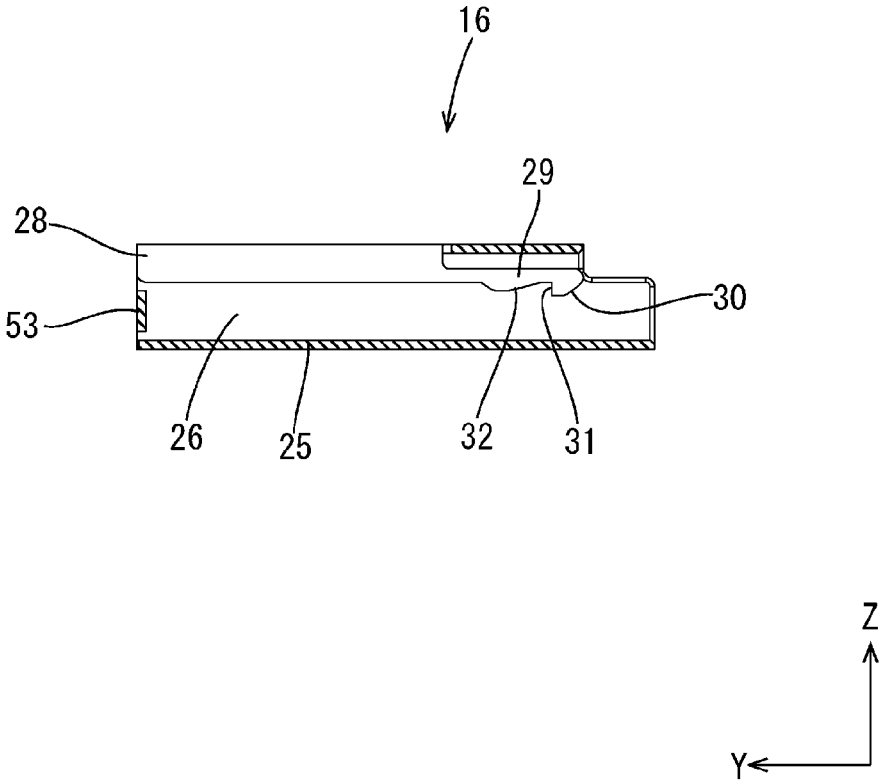
FIG. 7 is a section showing the cover.
Figure 8:
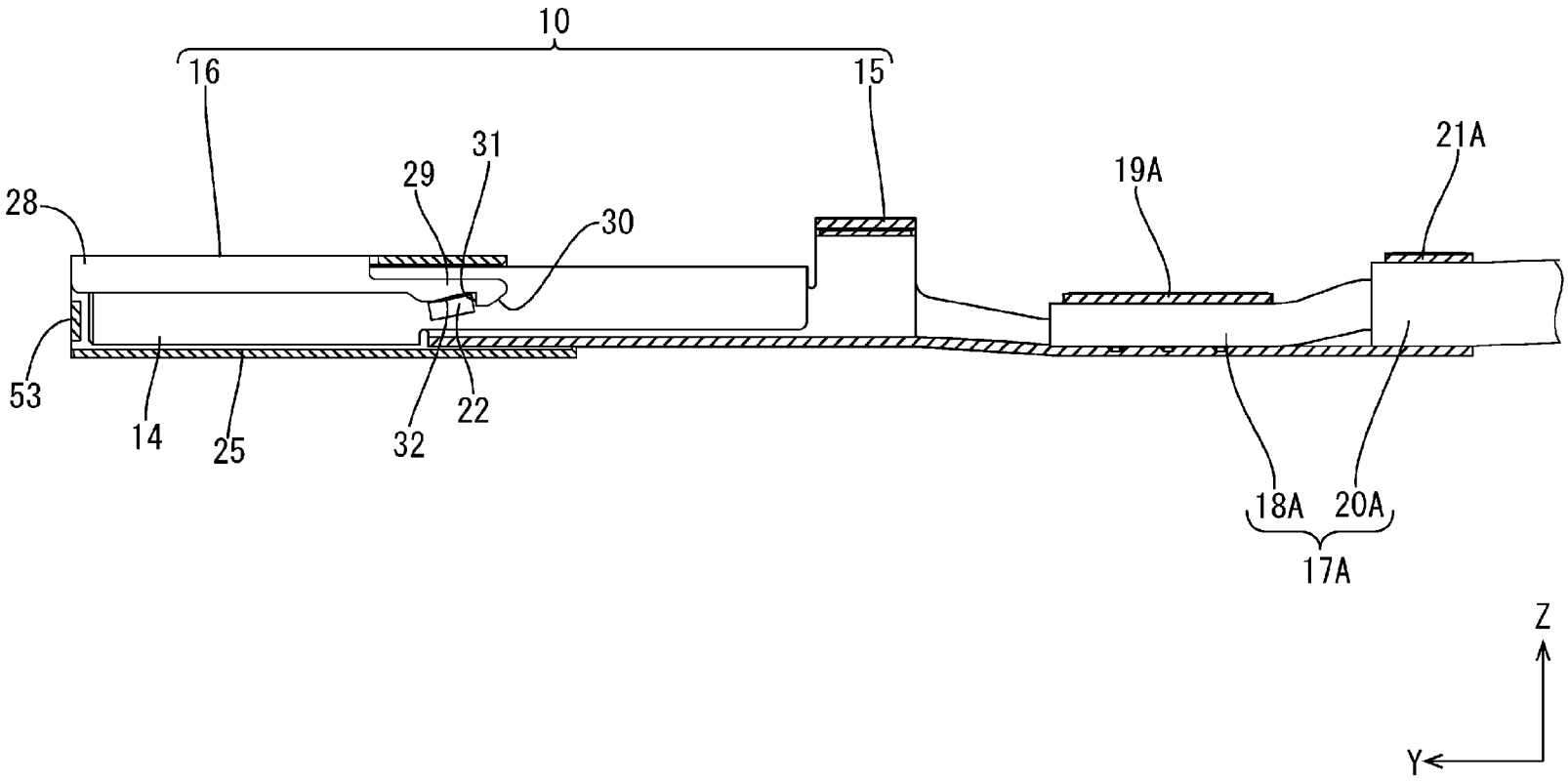
FIG. 8 is a section showing a state where the cover is disposed at the protection position in the male terminal connected to an end part of a wire.
Figure 9:
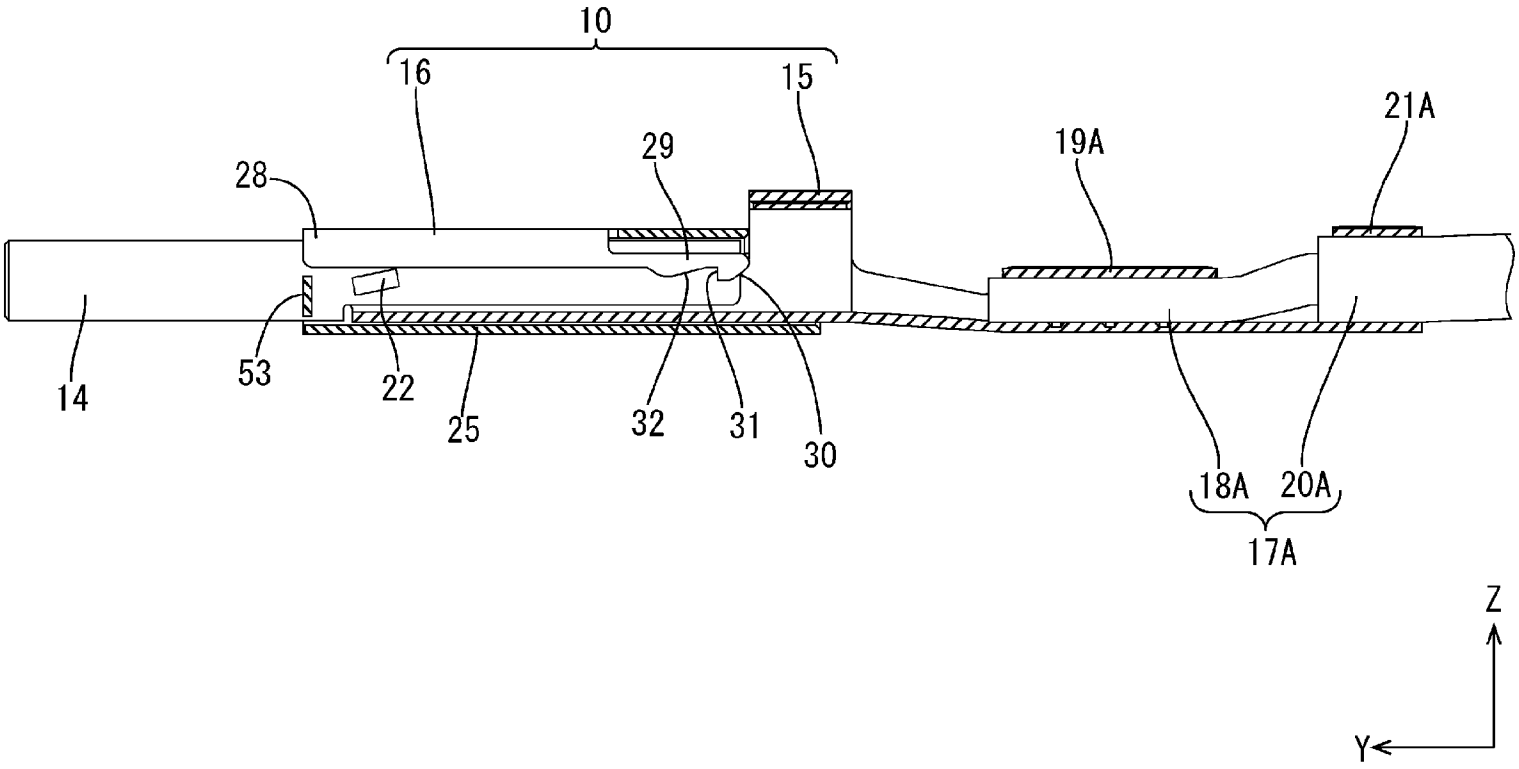
FIG. 9 is a section showing a state where the cover is disposed at the retracted position in the male terminal connected to the end part of the wire.

As shown in FIGS. 1, 3 and 7, the cover 16 is substantially in the form of a rectangular tube extending in the front-rear direction. The cover 16 is formed by press-working a metal plate material into a predetermined shape. The cover 16 includes a sheath portion 24 capable of accommodating the tab 14. The sheath portion 24 is in the form of a rectangular tube extending in the front-rear direction. An internal space of the sheath portion 24 is formed larger than a cross-section of the tab 14 orthogonal to the front-rear direction. In this way, the sheath portion 24 is slidable in the front-rear direction with respect to the tab 14.

The sheath portion 24 includes a lower wall 25, a right side wall 26 rising from the right side edge of the lower wall 25, an upper wall 27 bent leftward from the upper end edge of the right side wall 26, and a left side wall 28 bent downward from the left end edge of the upper wall 27. A front retaining/engaging portion 29 for coming into contact with the front retaining portion 22 of the tab 14 from behind is formed on a rear end part of the left side wall 28. The front retaining/engaging portion 29 is formed by cutting the lower end edge of the left side wall 28 upwardly and hook-shaped when viewed laterally. The rear end edge of the front retaining/engaging portion 29 is disposed substantially at the same position as or somewhat in front of the rear end edge of the upper wall 27. The front retaining/engaging portion 29 is resiliently deformable in the vertical direction.

An assembly guiding surface 30 inclined downwardly toward the front is formed on a rear end part of the front retaining/engaging portion 29. A locking surface 31 cut upwardly and perpendicular to the front-rear direction is formed at a position somewhat in front of the assembly guiding surface 30. A semi-locking surface 32 formed into a gentle curve when viewed laterally is formed at a position in front of the locking surface 31.

An outer side wall 52 rising upward is formed to extend in the front-rear direction on the left end edge of the lower wall 25 of the sheath portion 24. A length in the front-rear direction of the outer side wall 52 is set equal to that of the sheath portion 24. A rear retaining/engaging portion 53 bent rightward is formed on a front end part of the outer side wall 52. The right end edge of the rear retaining/engaging portion 53 is disposed substantially at the same position as the left side wall 28 of the sheath portion 24 and does not project inwardly of the sheath portion 24.

The rear retaining/engaging portion 53 comes into contact with the front end edge of the extended side wall 23 of the terminal body 15 from front, whereby the cover 16 is prevented from coming off rearward. With the rear retaining/engaging portion 53 held in contact with a front end edge 55 (an example of a rear retaining portion) of the extended side wall 23 of the terminal body 15 from front, the tab 14 extending forward is exposed from a front end part of the sheath portion 24. This state is a state where the cover 16 is disposed at a retracted position with respect to the terminal body 15.

(Male Connector 11)

Figure 10:
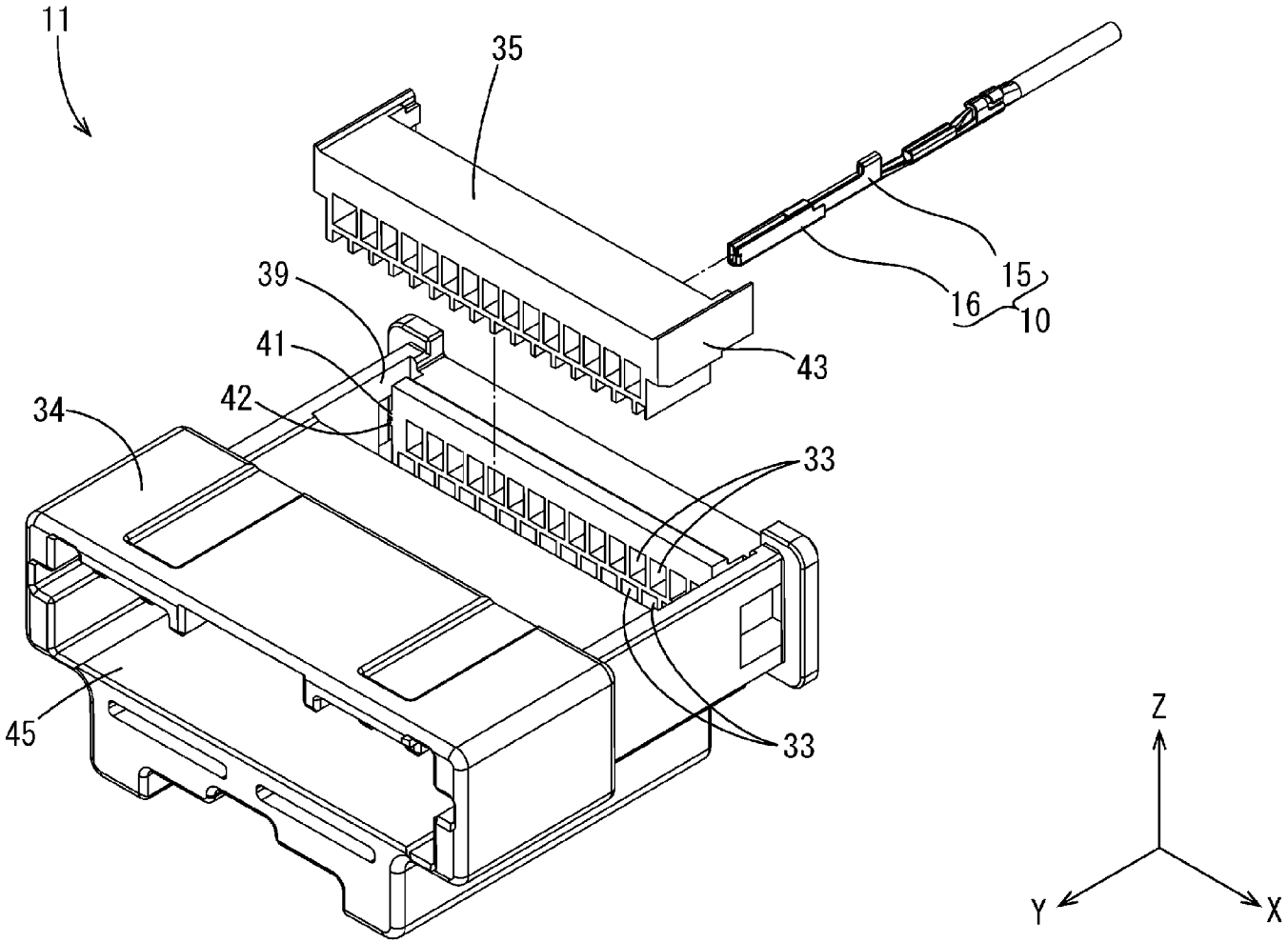
FIG. 10 is an exploded perspective view showing a male connector.

As shown in FIG. 10, the male connector 11 includes a male housing 34 having cavities 33 for accommodating the male terminals 10 and a retainer 35 to be mounted into the male housing 34 to retain the male terminals 10 by engaging the male terminals 10.

(Male Housing 34)

As shown in FIGS. 10 to 13, the male housing 34 is in the form of a block. A plurality of cavities 33 are arranged in the lateral direction in each of two upper and lower stages in the male housing 34. The respective cavities 33 formed in the upper stage and those formed in the lower stage are shifted in the lateral direction. Note that the number of the plurality of cavities 33 is arbitrary, and the plurality of cavities 33 may be arranged in one stage or arranged in three or more stages in the vertical direction. The male housing 34 includes a receptacle 45 open forward and externally fittable to the female connector 12. Each cavity 33 is open forward in the receptacle 45 of the male housing 34 and open rearward in a rear end part of the male housing 34.

An area of the upper wall of the cavity 33 near a center in the front-rear direction projects downward. In this way, the inner wall of the cavity 33 is formed with a step at a position near the center in the front-rear direction. This step serves as a terminal front stop portion 38 with which the front end edge of the terminal body 15 of the male terminal 10 comes into contact from behind.

An opening 39 communicating with the cavities 33 in the upper and lower stages is formed in the upper surface of the male housing 34. The retainer 35 is mounted into the opening 39 to close this opening 39.

As shown in FIG. 10, partial locking portions 41 for locking the retainer 35 at a partial locking position and full locking portions 42 at positions below the partial locking portions 41 for locking the retainer 35 at a full locking position are formed to project from the inner wall of the opening 39 of the male housing 34. Lock receiving portions 43 to be resiliently locked to these partial locking portions 41 and full locking portions 42 are provided on both left and right side parts of the retainer 35.

(Female Connector 12)

Figure 14:
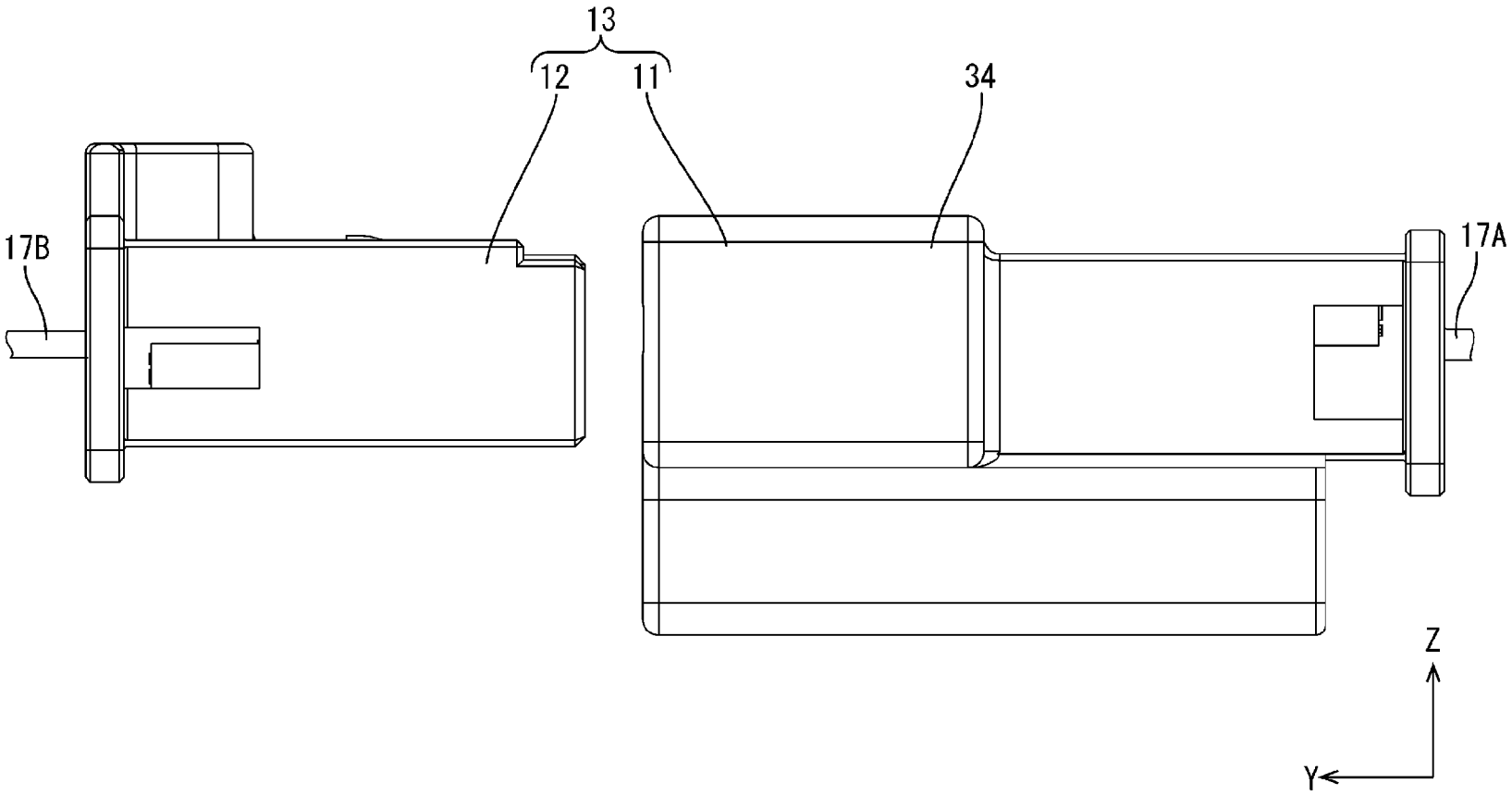
FIG. 14 is a side view showing a state before a female connector and the male connector are connected.
Figure 15:
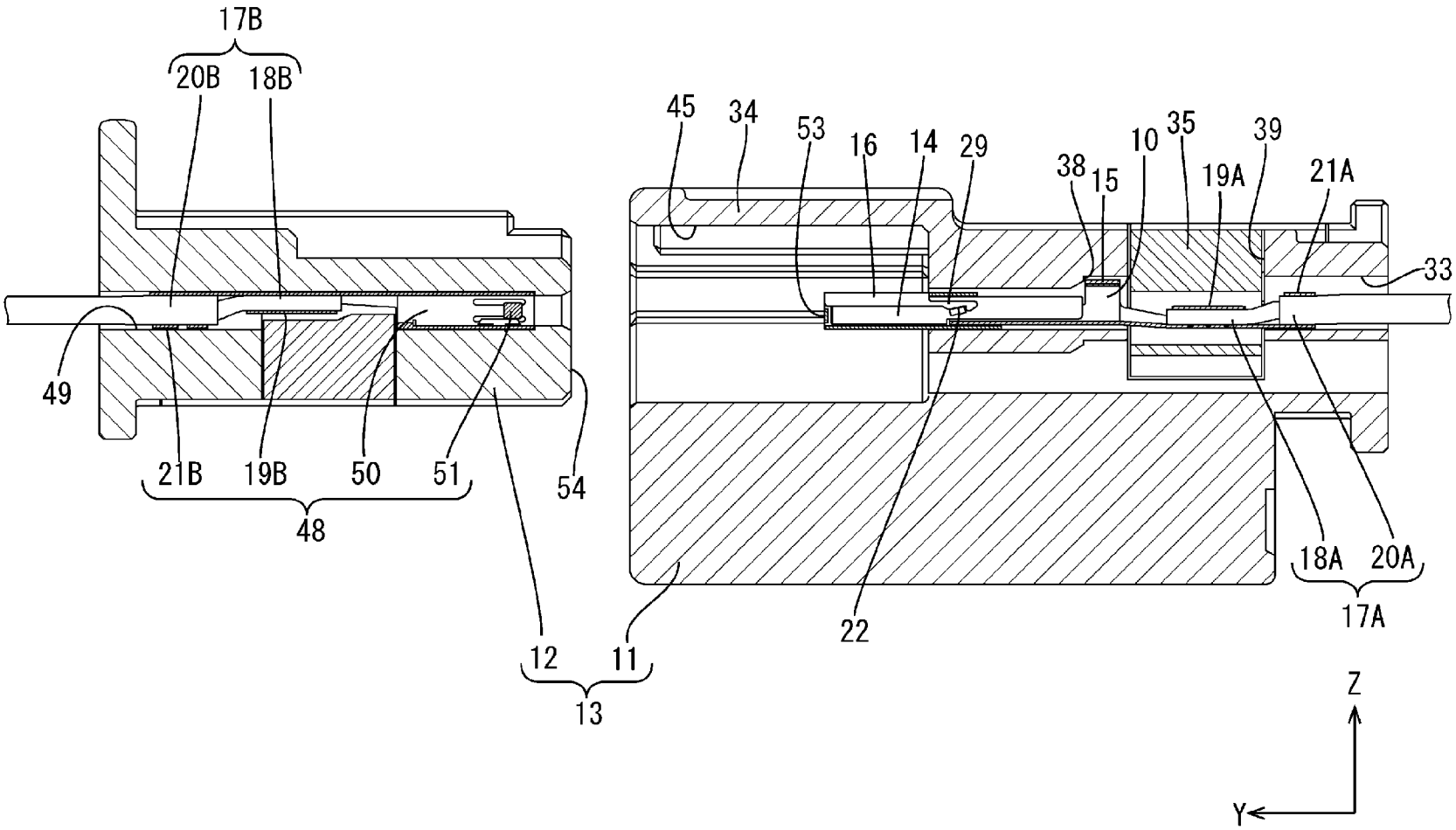
FIG. 15 is a section showing the state before the female connector and the male connector are connected.

As shown in FIGS. 14 and 15, the female connector 12 includes cavities 49 for accommodating female terminals 48 connected to ends of wires 17B. The female connector 12 is formed by injection-molding a synthetic resin. The female connector 12 has a substantially rectangular parallelepiped shape. Front end parts of the cavities 49 are open forward, and the tabs 14 are insertable thereinto.

The female terminal 48 includes a connecting tube portion 50 into which the tab 14 is inserted. A resiliently deformable resilient contact piece 51 is provided inside the connecting tube portion 50. The tab 14 having entered the connecting tube portion 50 and the resilient contact piece 51 resiliently contact each other to electrically connect the male terminal 10 and the female terminal 48.

The wire 17B is such that an insulation coating 20B surrounds the outer periphery of a core 18B. The female terminal 48 includes a wire barrel 19B connected in front of the connecting tube portion 50 and to be crimped to the core 18B, and an insulation barrel 21B connected in front of the wire barrel 19B and to be crimped to the insulation coating 20B.

A rear end part of the female connector 12 serves as a cover contact portion 54 for coming into contact with the front surfaces of the rear retaining/engaging portions 53 of the covers 16 from front while being inserted in the receptacle 45.

(Assembling Process of Connector Pair 13)

Next, an example of an assembling process of the connector pair 13 is described. First, an example of a process of mounting the cover 16 on the terminal body 15 is described. The front end part of the tab 14 is inserted into the sheath portion 24 of the cover 16 from behind. Then, the assembly guiding surface 30 formed on the rear end part of the front retaining/engaging portion 29 of the cover 16 comes into contact with the front end part of the front retaining portion 22 of the tab 14 from front.

Since the front retaining portion 22 is formed to be inclined downwardly toward the front, the assembly guiding surface 30 of the cover 16 moves upward along the upper surface of the front retaining portion 22 and the front retaining/engaging portion 29 is resiliently deformed upwardly. If the tab 14 is further pushed forward, the front retaining/engaging portion 29 is restored and the rear end part of the front retaining portion 22 of the tab 14 comes into contact with the locking surface 31 of the front retaining/engaging portion 29 of the cover 16 from front, whereby the cover 16 is prevented from coming off forward. Further, a rearward movement of the cover 16 is restricted by the contact of the semi-locking surface 32 formed on the lower surface of the front retaining/engaging portion 29 and the front retaining portion 22 formed to be inclined downwardly toward the front. In this way, the cover 16 is temporarily held in a semi-locked state at a protection position where the tab 14 is accommodated in the sheath portion 24 of the cover 16 (see FIG. 8).

Figure 11:
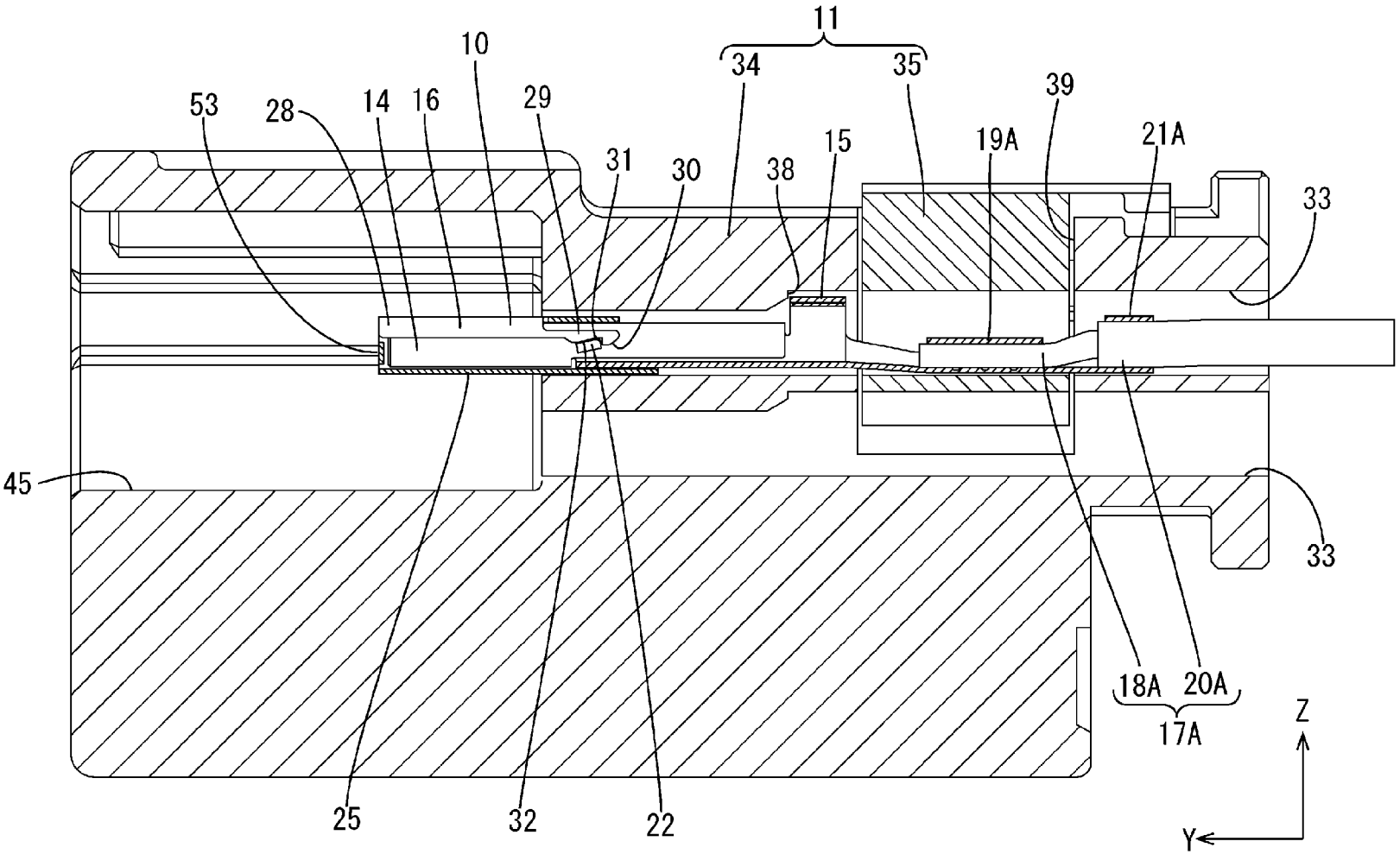
FIG. 11 is a section showing a state where a retainer is held at a partial locking position with the male terminal disposed in a cavity of a male housing.
Figure 12:
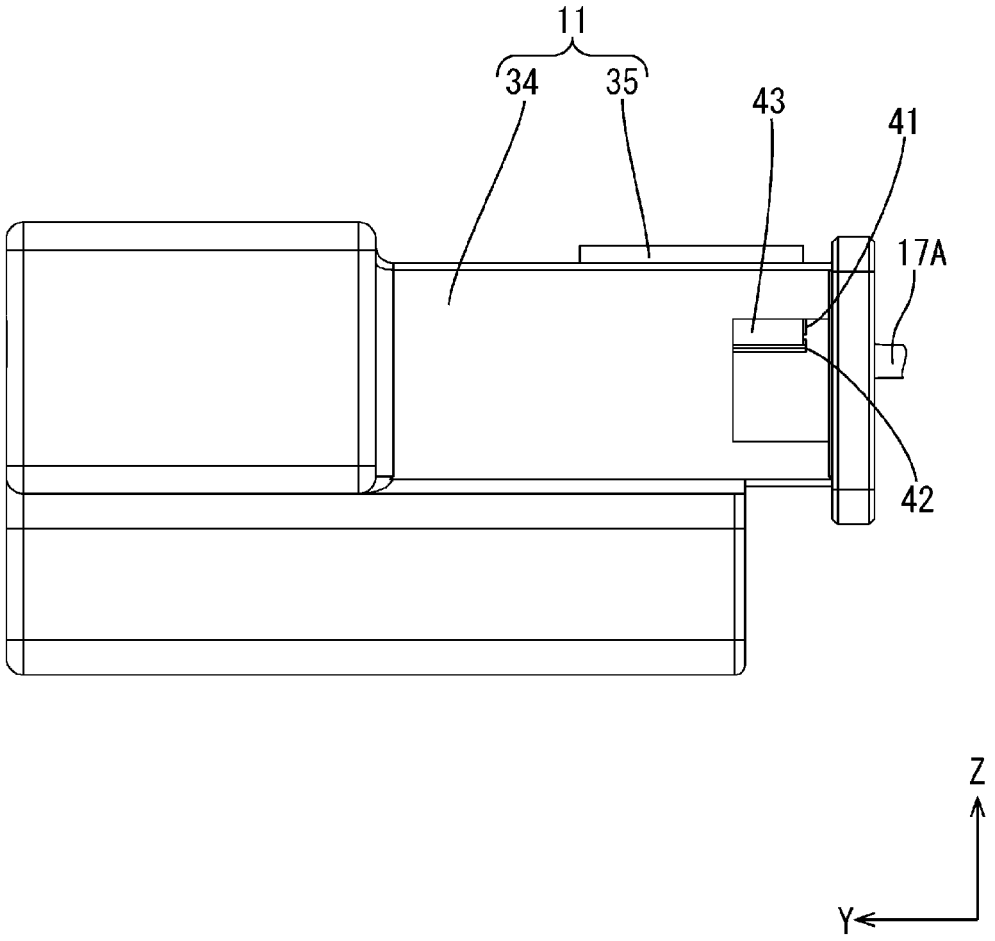
FIG. 12 is a side view showing the state where the retainer is held at the partial locking position with the male terminal disposed in the cavity of the male housing.

Next, an example of an assembling process of the male connector 11 is described. As shown in FIGS. 11 and 12, the male terminal 10 connected to the end part of the wire 17A is inserted into the cavity 33 from behind with the retainer 35 held at the partial locking position with respect to the male housing 34. At this time, the cover 16 of the male terminal 10 is held at the protection position and the tab 14 is protected by the sheath portion 24 of the cover 16.

If the male terminal 10 is pushed forward into the cavity 33, the front end edge of the terminal body 15 of the male terminal 10 comes into contact with the terminal front stop portion 38 of the cavity 33 from behind. In this way, the male terminal 10 is prevented from coming out forward.

Figure 13:
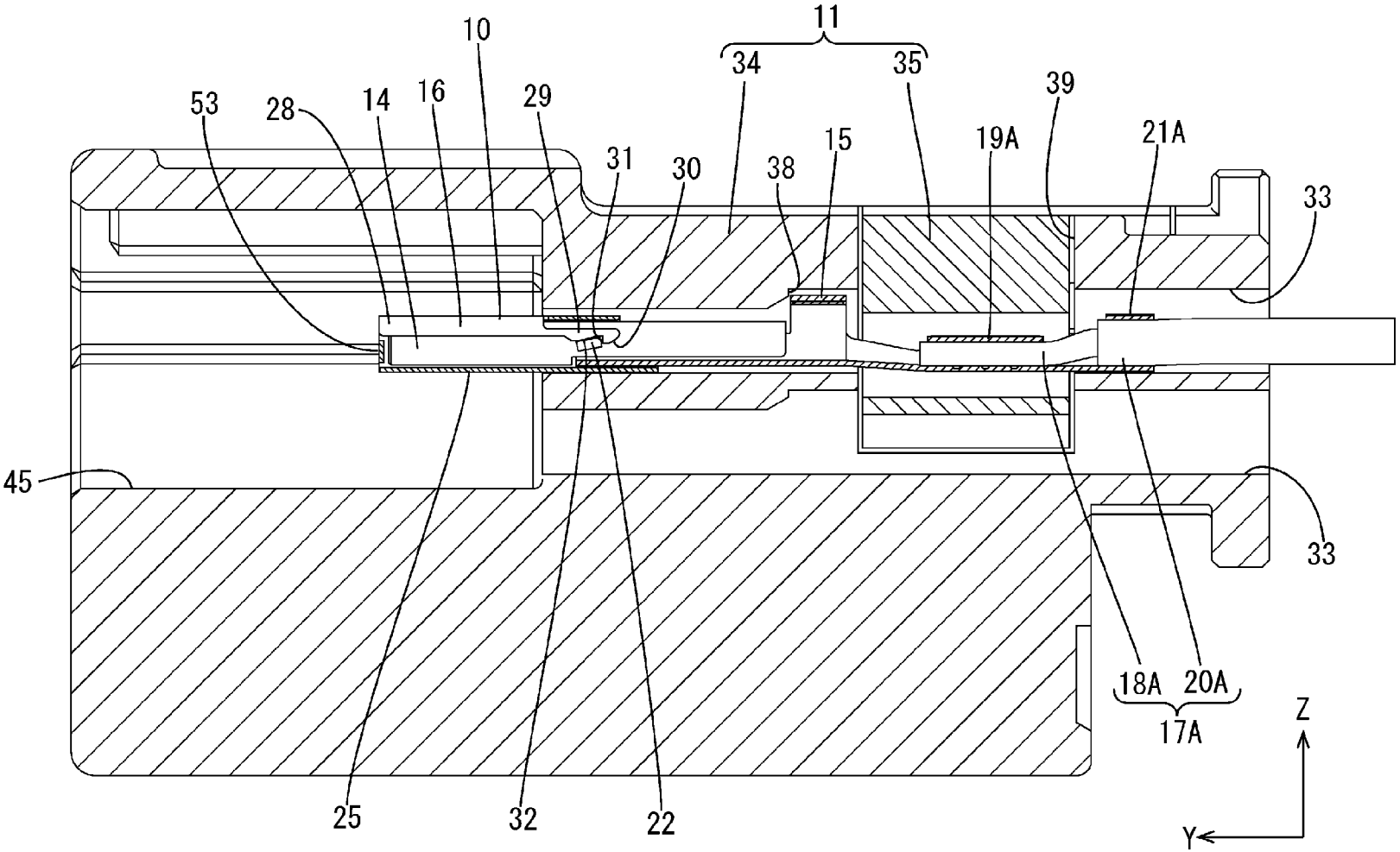
FIG. 13 is a section showing a state where the retainer is held at a full locking position with the male terminal disposed in the cavity of the male housing.

Subsequently, as shown in FIG. 13, the retainer 35 is moved to the full locking position and held thereat. In this way, the male terminal 10 is prevented from coming out rearward by the contact of the front end edge of the retainer 35 with the rear end edge of the terminal body 15 of the male terminal 10 from behind. In this state, the tab 14 protected by the cover 16 held at the protection position is located in the receptacle 45.

Next, an example of a connecting process of the male connector 11 and the female connector 13 is described. As shown in FIG. 15, the tabs 14 protected by the sheath portions 24 of the covers 16 held at the protection position project forward in the receptacle 45 of the male housing 11 before connection.

Figure 16:
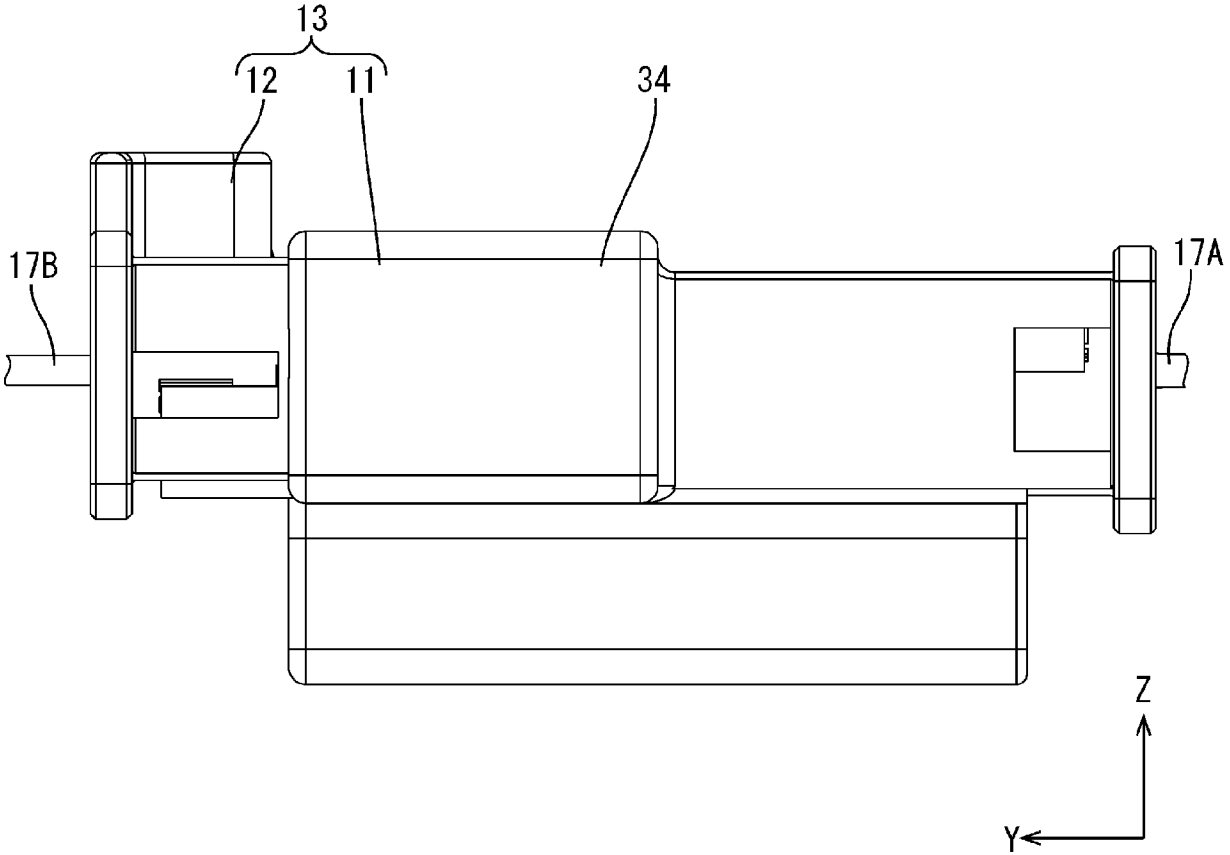
FIG. 16 is a side view showing a state where a cover contact portion is in contact with the cover in a connection process of the female connector and the male connector.
Figure 17:
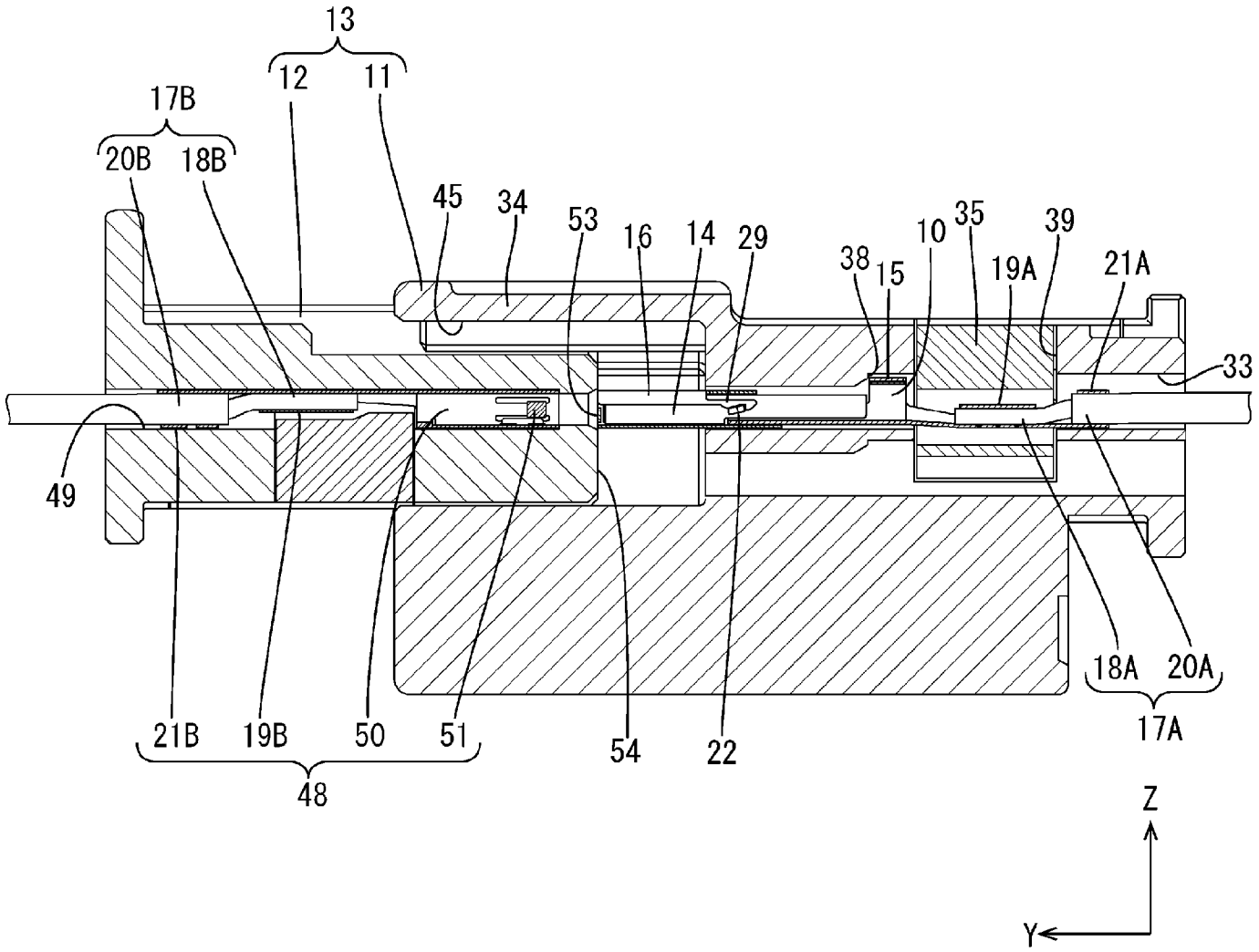
FIG. 17 is a section showing the state where the cover contact portion is in contact with the cover in the connection process of the female connector and the male connector.
Figure 18:
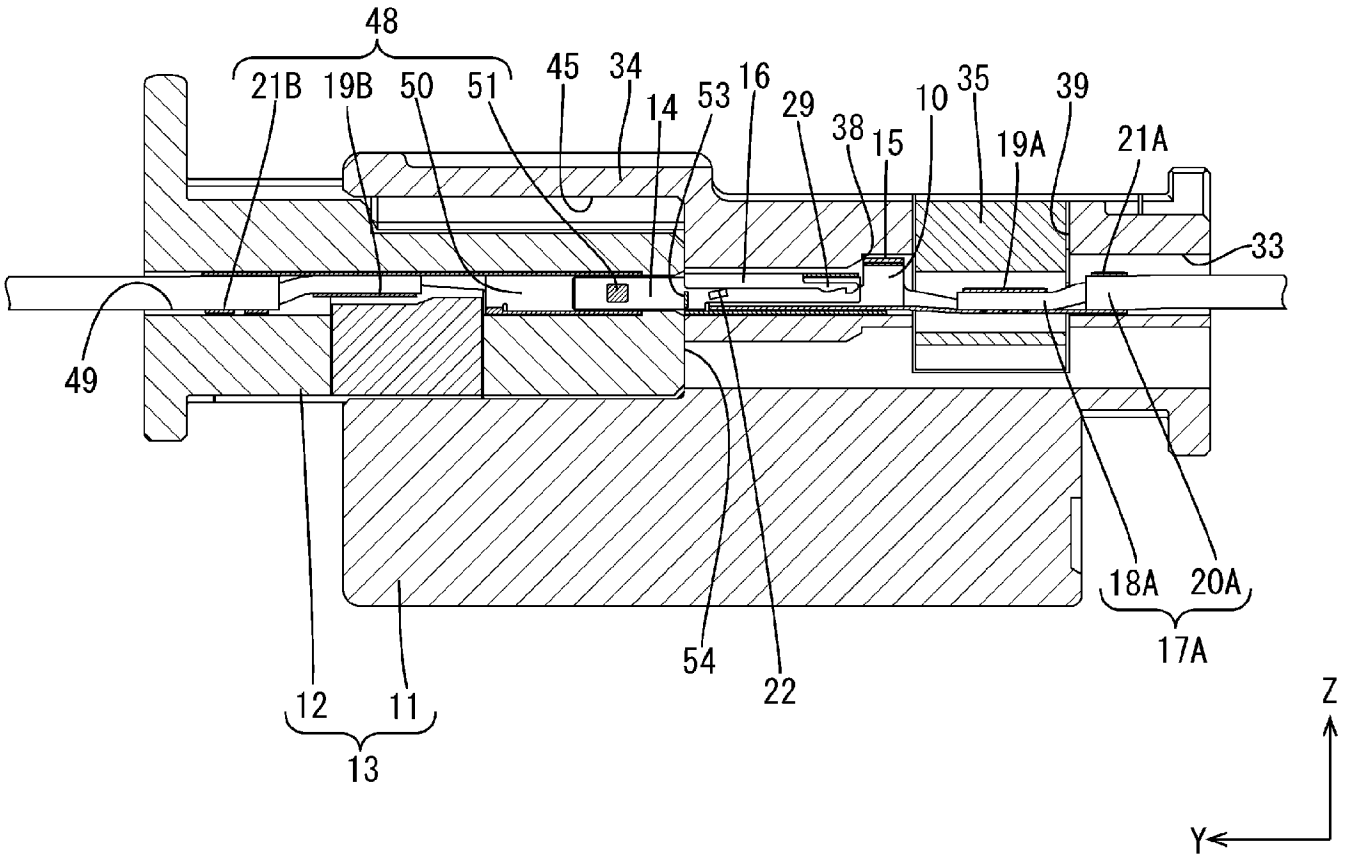
FIG. 18 is a section showing a state where the connection of the female connector and the male connector is completed.

As shown in FIGS. 16 and 17, the female connector 12 is inserted into the receptacle 45 of the male connector 11 from behind. Then, the cover contact portion 54 on the rear end part of the female connector 12 come into contact with the front surfaces of the rear retaining/engaging portions 53 of the covers 16 from front. If the female connector 12 is pushed further rearward, the covers 16 are slid rearward by the cover contact portion 54. At this time, the semi-locking surfaces 32 of the front retaining/engaging portion 29 ride on the front retaining portions 22 and the front retaining/engaging portions 29 are deflected and deformed. If the female connector 12 is pushed further rearward, the front retaining/engaging portions 29 are restored and the semi-locking of the front retaining/engaging portions 29 and the front retaining portions is released.

Thereafter, as the female connector 12 is pushed rearward, the covers 16 move rearward by being pressed by the cover contact portion 54 and the tabs 14 start projecting forward from the front end parts of the sheath portions 24. The tabs 14 projecting forward from the front end parts of the sheath portions 24 enter the cavities 49 of the female connector 12 and are inserted into the connecting tube portions 50 of the female terminals 48 disposed in the cavities 49.

With the connection of the female connector 12 and the male connector 11 completed, the covers 16 have been moved to the retracted position by the cover contact portion 54 of the female connector 12. The tabs 14 are exposed from the front end parts of the sheath portions 24 of the covers 16. As described above, the exposed tabs 14 enter the cavities 49 of the female connector 12, are inserted into the connecting tube portions 50 of the female terminals 48 disposed in the cavities 49 and contact the resilient contact pieces 51 in the connecting tube portions 50 (see FIG. 18). In this way, the male terminals 10 and the female terminals 48 are electrically connected.

(Functions and Effects of Embodiment)

Next, functions and effects of this embodiment are described. According to this embodiment, the male terminal 10 includes the terminal body 15 having the tab 14 extending forward and the cover 16 slidable between the protection position where the tab 14 is accommodated inside the sheath portion 24 and the retracted position where the front end part of the tab 14 is exposed from the front end of the sheath portion 24.

According to the above configuration, since the tab 14 can be accommodated into the sheath portion 24 by moving the cover 16 to the protection position, the tab 16 can be protected from collision from an external matter. Further, a mating terminal and the tab 14 can be electrically connected by moving the cover 16 to the retracted position and exposing the tab 14.

According to this embodiment, the tab 14 is provided with the front retaining portion 22 for restricting a forward movement of the cover 16 beyond the protection position by engaging the front retaining/engaging portion 29 provided on the cover 16 from front. In this way, the cover 16 can be prevented from coming off forward.

According to this embodiment, the rear retaining portion for restricting a rearward movement of the cover 16 beyond the retracted position by engaging the rear retaining/engaging portion provided on the cover 16 from behind is provided on the side wall of the terminal body 15. In this way, the cover 16 can be prevented from coming off rearward.

The connector pair 13 according to this embodiment includes the male connector 11 provided with the male terminals 10 and the female connector 12 to be connected to the male connector 11, the male connector 11 includes the receptacle 45 to be externally fit to the female connector 12, the tabs 14 accommodated in the sheath portions 24 of the covers 16 held at the protection position are disposed in the receptacle 45, the female connector 12 includes the cover contact portion 54 for coming into contact with the front end parts of the covers 16 from front, and the covers 16 are moved from the protection position to the retracted position by the cover contact portion 54 coming into contact with the covers 16 from front in connecting the female connector 12 to the male connector 11.

According to the above configuration, since the covers 16 can be moved from the protection position to the retracted position in the process of connecting the female connector 12 and the male connector 11, the efficiency of a connecting operation of the connector pair 13 can be improved.

Other Embodiments

The technique disclosed in this specification is not limited to the above described and illustrated embodiment. For example, the following embodiments are also included in the technical scope of the technique disclosed in this specification.

(1) The front retaining portion 22 may be provided on the terminal body 15.

(2) The rear retaining portion may be provided on the tab 14.

(3) An arbitrary material such as synthetic resin or ceramic can be appropriately selected according to need as a material constituting the cover 16.

(4) The cover 16 may be moved from the protection position to the retracted position by inserting an unillustrated jig into the receptacle 45 of the male connector 11 before the male connector 11 and the female connector 12 are connected.

LIST OF REFERENCE SIGNS

10: male terminal
11: male connector
12: female connector
13: connector pair
14: tab
15: terminal body
16: cover
22: front retaining portion
24: sheath portion
29: front retaining/engaging portion
45: receptacle
53: rear retaining/engaging portion
54: cover contact portion
55: front end edge of extended side wall (example of rear retaining portion)

The invention claimed is:

1. A male terminal, comprising:

a terminal body and a tab extending forward from the terminal body, and a front retaining portion provided on either one of the tab and the terminal body;

a cover configured to be slidable between a protection position where the tab is accommodated inside a sheath portion of the cover and a retracted position where a front end part of the tab is exposed from a front end of the sheath portion, and the sheath portion comprising:

a lower wall, a first side wall rising from a side edge of the lower wall, an upper wall bent inwardly from an upper end edge of the first side wall, a second side wall bent downward from an edge of the upper wall, and a front retaining/engaging portion provided on a rear end part of the second side wall; and wherein the front retaining/engaging portion of the sheath is configured to come into contact with the front retaining portion from behind.

2. The male terminal of claim 1, wherein the front retaining portion is configured to restrict a forward movement of the cover beyond the protection position by engaging the front retaining/engaging portion.

3. The male terminal of claim 1, wherein the front retaining/engaging portion is resiliently deformable in a vertical direction with respect to the lower wall.

4. The male terminal of claim 1, further comprising a rear retaining portion configured to restrict a rearward movement of the cover beyond the retracted position by engaging a rear retaining/engaging portion provided on the cover from behind is provided on either one of the tab and the terminal body.

5. The male terminal of claim 2, further comprising a rear retaining portion configured to restrict a rearward movement of the cover beyond the retracted position by engaging a rear retaining/engaging portion provided on the cover from behind is provided on either one of the tab and the terminal body.

6. A connector pair, comprising:

a male connector including the male terminal of claim 1, and a female connector connectable to the male connector, wherein:

the male connector includes a receptacle having an inner surface that is configured to be fit to an exterior of the female connector, the tab accommodated in the sheath portion of the cover held at the protection position is disposed in the receptacle, the female connector includes a cover contact portion configured to come into contact with a front end part of the cover from the front, and the cover is moved from the protection position to the retracted position by the cover contact portion coming into contact with the cover from the front in connecting the female connector to the male connector.

* * * * *